US006739865B1

(12) United States Patent
Jamison

(10) Patent No.: US 6,739,865 B1
(45) Date of Patent: May 25, 2004

(54) SYSTEM AND METHOD FOR DISABLING A FURNACE

(76) Inventor: Jeffrey W. Jamison, 62 Scott Dr., Wappingers Falls, NY (US) 12590

( * ) Notice: Subject to any disclaimer, the term of this patent is extended or adjusted under 35 U.S.C. 154(b) by 0 days.

(21) Appl. No.: 10/365,728

(22) Filed: Feb. 12, 2003

(51) Int. Cl.[7] ..... F23N 5/24
(52) U.S. Cl. ..... 431/89; 431/16; 431/22
(58) Field of Search ..... 431/89, 90, 22, 431/15, 16

(56) References Cited

U.S. PATENT DOCUMENTS

| | | | | |
|---|---|---|---|---|
| 3,744,508 | A | | 7/1973 | Hansen et al. |
| 3,871,397 | A | | 3/1975 | Larsen |
| 3,938,936 | A | | 2/1976 | Vizmeg |
| 3,976,421 | A | | 8/1976 | Lee et al. |
| 4,039,637 | A | * | 8/1977 | Grosseau ..... 261/36.2 |
| 4,114,448 | A | | 9/1978 | Merritt |
| 4,168,141 | A | | 9/1979 | Saito |
| 4,235,587 | A | | 11/1980 | Miles |
| 4,278,419 | A | | 7/1981 | Bechtel et al. |
| 4,282,757 | A | | 8/1981 | Cohn |
| 4,299,557 | A | | 11/1981 | Brouwer |
| 4,490,105 | A | | 12/1984 | Hunsberger et al. |
| 4,551,076 | A | | 11/1985 | DuBois |
| 4,585,169 | A | | 4/1986 | Kinsey |
| 4,622,999 | A | * | 11/1986 | Ray ..... 137/601.01 |
| 4,662,838 | A | | 5/1987 | Riordan |
| 4,708,156 | A | | 11/1987 | Knudsen |
| 5,240,593 | A | | 8/1993 | Moredock |
| 5,375,620 | A | | 12/1994 | Ginder, Jr. |
| 5,692,680 | A | | 12/1997 | Harwath et al. |
| 5,756,899 | A | | 5/1998 | Ugai et al. |
| 6,076,408 | A | | 6/2000 | Matsubara et al. |
| 6,128,176 | A | | 10/2000 | Radichio |
| 6,247,919 | B1 | | 6/2001 | Welz, Jr. et al. |
| 6,289,737 | B1 | | 9/2001 | Kouketsu et al. |
| 6,299,433 | B1 | | 10/2001 | Gauba et al. |
| 6,390,028 | B1 | | 5/2002 | Langmead et al. |

* cited by examiner

*Primary Examiner*—Jiping Lu
(74) *Attorney, Agent, or Firm*—Schmeiser, Olsen & Watts

(57) ABSTRACT

A system and method for disabling an oil furnace based on a vacuum level measurement. The oil furnace includes a pump and a burning device. The pump is adapted to transfer oil from a storage device to the burning device. A measurement device adapted to measure a vacuum level between an output of the storage device and an input of the pump. A means for disabling power to the oil furnace is adapted to disable power to the oil furnace based on a first specified vacuum level measurement set point.

28 Claims, 3 Drawing Sheets

SYSTEM AND METHOD FOR DISABLING A FURNACE

BACKGROUND OF THE INVENTION

1. Technical Field

The present invention relates to an apparatus and associated method to disable incoming power to an oil furnace.

2. Related Art

An oil furnace typically does not provide much flexibility in detecting a furnace malfunction. Thus there is a need to provide more flexibility in the detection of a furnace malfunction.

SUMMARY OF THE INVENTION

The present invention provides a system, comprising:

an oil furnace, a storage device, and means for disabling power to the oil furnace, wherein the oil furnace comprises a pump and a burning device, wherein the pump is adapted to transfer oil from the storage device to the burning device, wherein the means for disabling power to the oil furnace comprises a measurement device adapted to measure a vacuum level in a fuel oil line between an output of the storage device and an input of the pump, and wherein the means for disabling power to the oil furnace is adapted to disable power to the oil furnace based on the vacuum level in relation to a first specified vacuum level measurement set point.

The present invention provides a method, comprising:

providing an oil furnace system comprising, an oil furnace, a storage device, and means for disabling power to the oil furnace, wherein the oil furnace comprises a pump and a burning device, and wherein the means for disabling power to the oil furnace comprises a measurement device;

transferring by the pump, oil from the storage device to the burning device;

measuring by the measurement device a vacuum level in a fuel oil line between an output of the storage device and an input of the pump;

disabling power to the oil furnace based on the vacuum level in relation to a first specified vacuum level measurement set point.

DETAILED DESCRIPTION OF THE INVENTION

Figure 1:
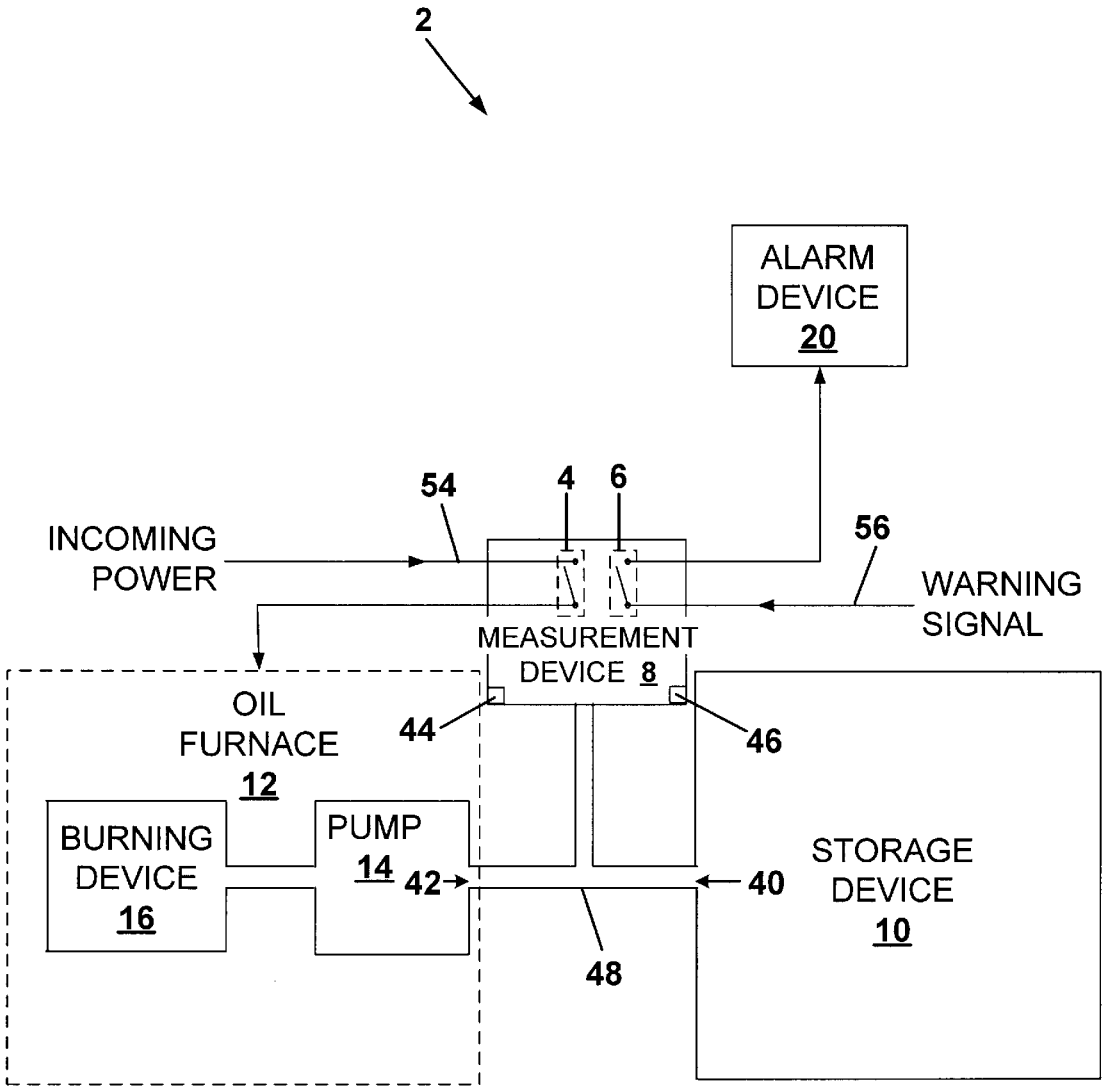
FIG. 1 depicts a block diagram of a system to disable power to an oil furnace, in accordance with embodiments of the present invention.

FIG. 1 depicts a block diagram of a system 2 to disable incoming power 54 to an oil furnace 12 based on a specified vacuum level measurement set point, in accordance with embodiments of the present invention. The system 2 comprises the oil furnace 12, a storage device 10, a measurement device 8, and an alarm device 20. The oil furnace 12 comprises a pump 14 and a burning device 16. The pump 14 transfers fuel oil from the storage device 10 to the burning device 16. The burning device 16 is adapted to pressurize and combine the fuel oil with air. The fuel oil/air mixture is sprayed as a fine mist and ignited by a spark thereby creating a flame for heating a heat exchanger. The oil furnace 12 may be any oil furnace known to a person of ordinary skill in the art. The burning device 16 may be any oil furnace burner known to a person of ordinary skill in the art. The measurement device 8 is adapted to measure a vacuum level within a fuel oil line 48 between an output 40 of the storage device and an input 42 of the pump. The measurement device 8 may be connected to the fuel oil line 48. Alternatively, the measurement device 8 may be located within the pump 14. The measurement device 8 comprises a switching means 4 that is normally closed (N/C) so that a signal path is maintained until the switching means 4 is activated. Under normal conditions the incoming power 54 from a fuse panel or any other power source is transmitted through the switching means 4 to energize the oil furnace 12. The incoming power 54 may comprise, inter alia, alternating current (AC) or direct current (DC), etc. The measurement device 8 comprises a first input means 44 for accepting a first specified vacuum level measurement set point so that when a vacuum level measured by the measurement device is equivalent to or exceeds the first specified vacuum level measurement set point, the switching means 4 opens thereby disabling the incoming power 54 to the oil furnace. The switching means 4 may be a latching switching means so that the incoming power 54 to the oil furnace 12 remains disabled until the switching means 4 is reset. The measurement device 8 may additionally comprise a second switching means 6 that is normally open (N/O) so that a signal path is interrupted until the switching means 6 is activated. Under normal conditions a warning signal 56 from a fuse panel or any other power source is unable to pass through the switching means 6. The warning signal 56 may be, inter alia, a control signal. The warning signal 56 may comprise, inter alia, alternating current (AC) or direct current (DC), etc. The measurement device 8 comprises a second input means 46 for accepting a second specified vacuum level measurement set point so that when a vacuum level measured by the measurement device is equivalent to or exceeds the second specified vacuum level measurement set point, the second switching means 6 closes thereby enabling the warning signal 56 to an alarm device 20. The alarm device 20 warns a user that there is a problem with the oil furnace. The second switching means 6 may be a latching switching means so that the warning signal 56 to the alarm device remains enabled until the second switching means 6 is reset. The switching means 4 and the second switching means 6 may be any switching means known to a person of ordinary skill in the art including, inter alia, a relay, a contactor, etc. The relay may be any relay known to a person of ordinary skill in the art including, inter alia, a mechanical relay, a solid state relay (SSR), a latching relay (mechanical or SSR), a timer relay (mechanical or SSR), etc. The vacuum level may be measured in any units known to a person of ordinary skill in the art such as, inter alia, inches of water, feet of water, inches of mercury, millimeters of mercury, etc. The first specified vacuum level measurement set point may be selected from a range of about 5 inches of water to about 15 inches of water. The second specified vacuum level measurement set point may be selected from a range of about 4 inches of water to about 20 inches of water. The first specified vacuum level measurement set point may be set at a lower vacuum level measurement than the second specified vacuum level measurement set point so that the alarm device 20 warns the user that there is a problem with the oil furnace after the furnace is shut down. Alternatively, the first specified vacuum level measurement set point may be set at a higher vacuum level measurement than the second specified vacuum level measurement set point so that the alarm device 20 warns the user that there is a problem with the oil furnace before the furnace is shut down. The alarm device 20 may be any alarm device known to a person of ordinary skill in the art such as, inter alia, a home security system, a bell, a flashing light, etc.

Figure 2:
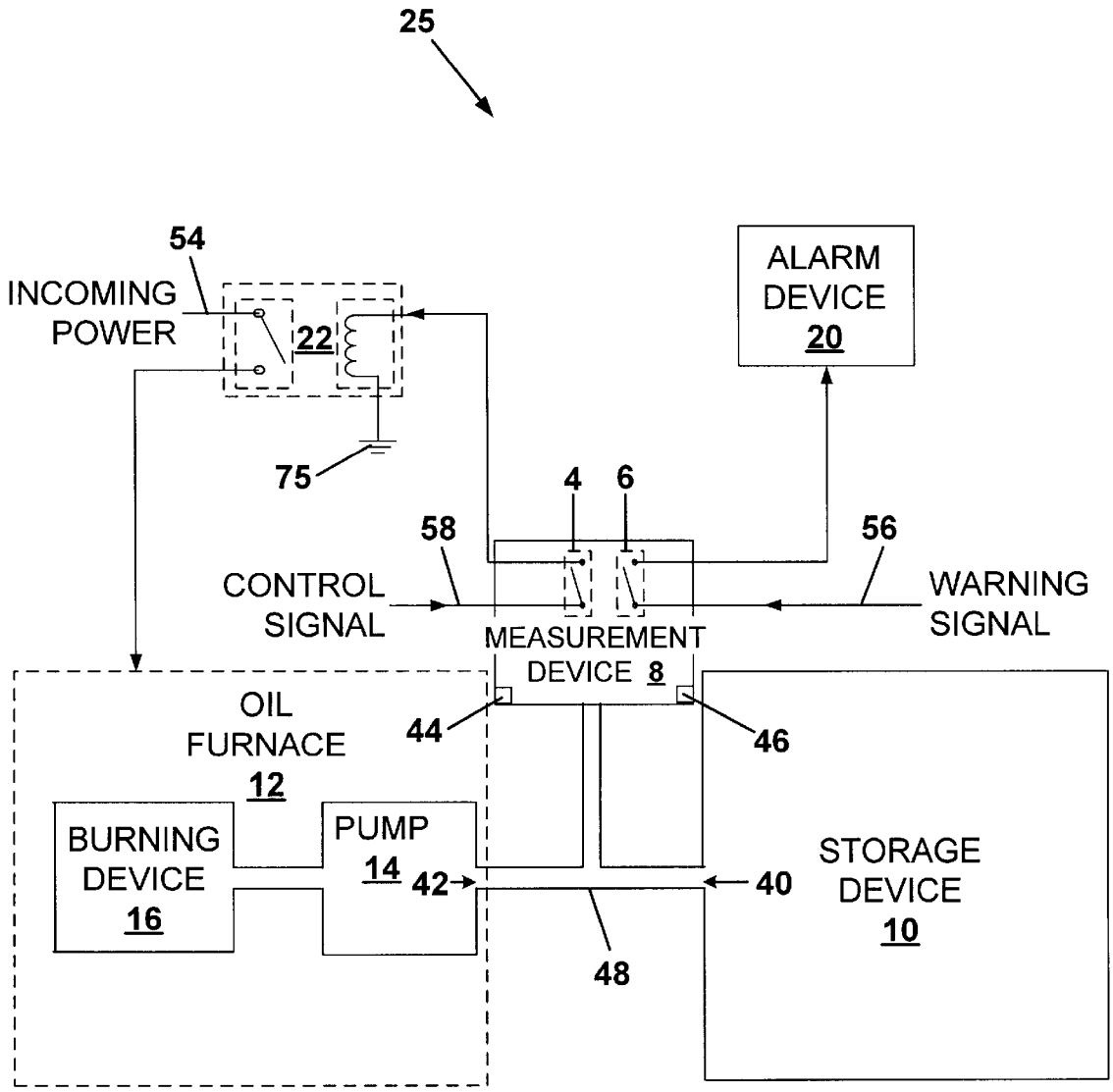
FIG. 2 illustrates a variation of FIG. 1 depicting a block diagram of a system to disable power to an oil furnace comprising an additional component, in accordance with embodiments of the present invention.

FIG. 2 illustrates a variation of FIG. 1 depicting a block diagram of a system 25 to disable incoming power 54 to an oil furnace 12 based on a specified vacuum level measurement set point, in accordance with embodiments of the present invention. In contrast with FIG. 1, the switching device 4 is normally open so that a signal path is interrupted until the switching means 4 is activated. Under normal conditions a control signal 58 from a fuse panel or any other power source is unable to pass through the switching means 4. The control signal 58 may comprise, inter alia, alternating current (AC) or direct current (DC), etc. Additionally, FIG. 2 comprises a third switching means 22 for switching the incoming power 54 to the oil furnace 12. The third switching means 22 is normally closed so that a signal path for the incoming power 54 to the furnace is maintained until the third switching means 22 is activated. When a vacuum level measurement is equivalent to or exceeds the first specified vacuum level measurement set point, the switching means 4 closes thereby enabling the control signal 58 to activate the third switching means 22 and ultimately disabling the incoming power 54 to the furnace. The third switching means 22 may be a latching switching means so that the incoming power 54 to the oil furnace 12 remains disabled until the third switching means 22 is reset. If the control signal 58 is a positive DC signal then a signal75 is a DC ground or negative signal related to the control signal 58. If the control signal 58 is a hot AC signal then the signal75 is an AC neutral signal related to the control signal 58. The third switching means 22 may be any switching means known to a person of ordinary skill in the art including, inter alia, a relay, a contactor, etc. The relay may be any relay known to a person of ordinary skill in the art including, inter alia, a mechanical relay, a solid state relay (SSR), a latching relay (mechanical or SSR), a timer relay (mechanical or SSR), etc. The contactor may be, inter alia, a latching contactor.

Figure 3:
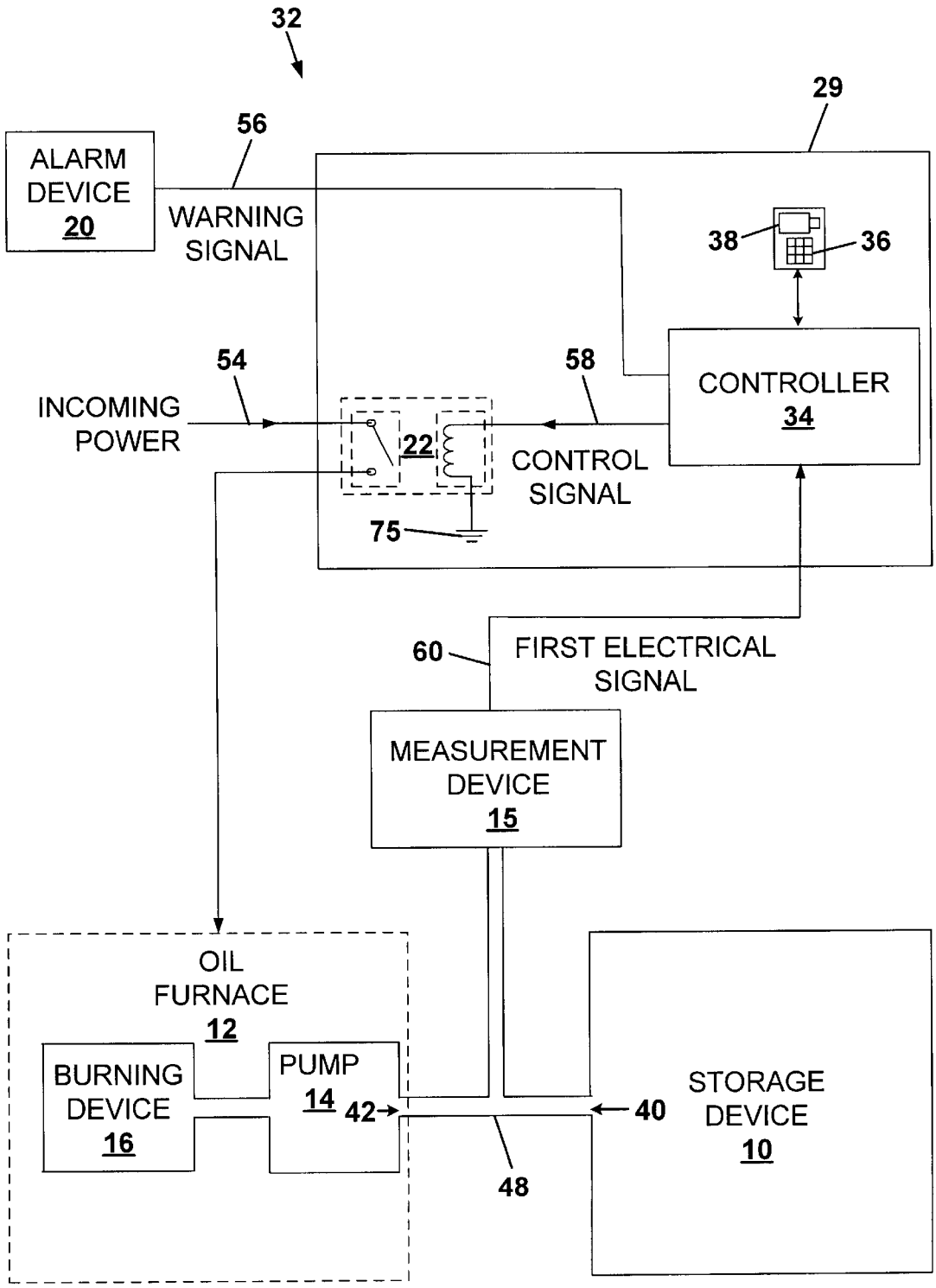
FIG. 3 illustrates a second variation of FIG. 1 depicting a block diagram of a system to disable power to an oil furnace comprising a control system, in accordance with embodiments of the present invention.

FIG. 3 illustrates a second variation of FIG. 1 depicting a block diagram of a system 32 to disable incoming power 54 to an oil furnace 12 based on a specified vacuum level measurement set point, in accordance with embodiments of the present invention. In contrast with FIG. 1, the system 32 comprises a measurement device 15 and a control system 29. The control system 29 comprises an input device 36, an output device 38, a controller 34, and a switching means 22. Under normal conditions the incoming power 54 from a fuse panel or any other power source is transmitted through the switching means 22 to energize the oil furnace 12. The switching means 22 is normally closed (N/C) so that a signal path for the incoming power 54 to the furnace is maintained until the switching means 22 is activated. The controller 34 may comprise a microprocessor and a signal conditioning device (e.g., Analog/Digital convertor, Digital/Analog converter DC/DC convertor, etc.). The measurement device 15 is adapted to convert a vacuum level measured by the measurement device to a first electrical signal 60 and transmit the first electrical signal 60 to the controller 34 within the control system 29. The input device 36 is adapted to accept and transmit the first vacuum level measurement set point of FIG. 1 to the controller 34. The controller 34 is adapted to convert the first specified vacuum level measurement set point to a second electrical signal. Additionally, the controller 34 is adapted to compare at least one level of the first electrical signal 60 to a level of the second electrical signal and create a first control signal 58 when the at least one level of the first electrical signal 60 is equivalent to or exceeds the level of the second electrical signal. The first control signal 58 activates the switching means 22 thereby disabling the incoming power 54 to the furnace 12. The switching means 22 may be a latching switching means so that the incoming power 54 to the oil furnace 12 remains disabled until the switching means 22 is reset. If the control signal 58 is a positive DC signal then a signal75 is a DC ground or negative signal related to the control signal 58. If the control signal 58 is a hot AC signal then the signal 75 is an AC neutral signal related to the control signal 58. The switching means 22 may be any switching means known to a person of ordinary skill in the art including, inter alia, a relay, a contactor, etc. The relay may be any relay known to a person of ordinary skill in the art including, inter alia, a mechanical relay, a solid state relay (SSR), a latching relay (mechanical or SSR), a timer relay (mechanical or SSR), etc. The contactor may be, inter alia, a latching contactor. The input device 36 is further adapted to accept and transmit the second vacuum level measurement set point of FIG. 1 to the controller 34. The controller 34 is adapted to convert the second specified vacuum level measurement set point to a third electrical signal. Additionally, the controller 34 is further adapted to compare a level of the third electrical signal to the at least one level of the first electrical signal 60 and transmit a warning signal 56 to an alarm device 20 when the at least one level of the first electrical signal 60 is equivalent to or exceeds the level of the third electrical signal. The warning signal 56 activates the alarm device 20. The output device 38 is adapted to display the first vacuum level measurement set point and the second vacuum level measurement set point. The output device 38 may be any output device known to a person of ordinary skill in the art including, inter alia, a liquid crystal display (LCD), an light emitting diode (LED), a cathode ray tube (CRT), etc. The input device 36 may be any input device known to a person of ordinary skill in the art including, inter alia, a keypad, a key board, etc. The measurement device 15 may be any measurement device known to a person of ordinary skill in the art including, inter alia, a transducer, etc. The first electrical signal 60 and the second electrical signal may be, inter alia, a voltage signal or a current signal.

While embodiments of the present invention have been described herein for purposes of illustration, many modifications and changes will become apparent to those skilled in the art. Accordingly, the appended claims are intended to encompass all such modifications and changes as fall within the true spirit and scope of this invention.

What is claimed is:

1. A system, comprising:

an oil furnace, a storage device, and means for disabling power to the oil furnace, wherein the oil furnace comprises a pump and a burning device, wherein the pump is adapted to transfer oil from the storage device to the burning device, wherein the means for disabling power to the oil furnace comprises a measurement device adapted to measure a vacuum level in a fuel oil line between an output of the storage device and an input of the pump, and wherein the means for disabling power to the oil furnace is adapted to disable power to the oil furnace based on the vacuum level in relation to a first specified vacuum level measurement set point.

2. The system of claim 1, wherein the measurement device further comprises a first input means for inputting the first specified vacuum level measurement set point.

3. The system of claim 2, wherein the measurement device further comprises a first switching means for disabling the power to the oil furnace when a vacuum level measured by the measurement device is equivalent to or exceeds the first specified vacuum level measurement set point.

4. The system of claim 3, wherein the measurement device further comprises a second input means for inputting a second specified vacuum level measurement set point and a second switching means for enabling a warning signal to an alarm device when a vacuum level measured by the measurement device is equivalent to or exceeds the second specified vacuum level measurement set point.

5. The system of claim 4, wherein the second specified vacuum level measurement set point is selected from a range of about 5 inches of water to about 9 inches of water, and wherein the first specified vacuum level measurement set point is selected from a range of about 9 inches of water to about 15 inches of water.

6. The system of claim 3, wherein the first specified vacuum level measurement set point is selected from a range of about 5 inches of water to about 15 inches of water.

7. The system of claim 2, wherein the means for disabling power to the oil furnace further comprises a switching device for disabling the power to the furnace, wherein the measurement device further comprises a first switching means for enabling a control signal, and wherein the control signal is adapted to activate the switching device to disable the power to the oil furnace when a vacuum level measured by the measurement device is equivalent to or exceeds the first specified vacuum level measurement set point.

8. The system of claim 7, wherein the measurement device further comprises a second input means for inputting a second specified vacuum level measurement set point and a second switching means for enabling a warning signal to an alarm device when a vacuum level measured by the measurement device is equivalent to or exceeds the second specified vacuum level measurement set point.

9. The system of claim 8, wherein the second specified vacuum level measurement set point is selected from a range of about 5 inches of water to about 9 inches of water, and wherein the first specified vacuum level measurement set point is selected from a range of about 9 inches of water to about 15 inches of water.

10. The system of claim 7, wherein the first specified vacuum level measurement set point is selected from a range of about 5 inches of water to about 15 inches of water.

11. The system of claim 1, wherein the means for disabling power to the oil furnace further comprises a control system, wherein the measurement device is further adapted to convert a vacuum level measured by the measurement device to a first electrical signal and transmit the first electrical signal to the control system, wherein the control system comprises a controller, an input means, and a switching device, wherein the input means is adapted to accept the first specified vacuum level measurement set point, wherein the controller is adapted to convert the first specified vacuum level measurement set point to a second electrical signal, wherein the controller is adapted to compare at least one level of the first electrical signal with a level of the second electrical signal and transmit a control signal to the switching device when the at least one level of the first electrical signal is equivalent to or exceeds the level of the second electrical signal, and wherein the control signal is adapted to activate the switching device to disable the power to the oil furnace.

12. The system of claim 11, wherein the input means is further adapted to accept a second specified vacuum level measurement set point, wherein the controller is further adapted to convert the second specified vacuum level measurement set point to a third electrical signal, wherein the controller is further adapted to compare a level of the third electrical signal to the at least one level of the first electrical signal and transmit a warning signal to an alarm device when the at least one level of the first electrical signal is equivalent to or exceeds the level of the third electrical signal.

13. The system of claim 12, wherein the second specified vacuum level measurement set point is selected from a range of about 5 inches of water to about 9 inches of water, and wherein the first specified vacuum level measurement set point is selected from a range of about 9 inches of water to about 15 inches of water.

14. The system of claim 11, wherein the first specified vacuum level measurement set point is selected from a range of about 5 inches of water to about 15 inches of water.

15. A method, comprising:

providing an oil furnace system comprising, an oil furnace, a storage device, and means for disabling power to the oil furnace, wherein the oil furnace comprises a pump and a burning device, and wherein the means for disabling power to the oil furnace comprises a measurement device;

transferring by the pump, oil from the storage device to the burning device;

measuring by the measurement device a vacuum level in a fuel oil line between an output of the storage device and an input of the pump;

disabling power to the oil furnace based on the vacuum level in relation to a first specified vacuum level measurement set point.

16. The method of claim 15, wherein the measurement device further comprises a first input means; and wherein the method further comprises;

accepting the first specified vacuum level measurement set point by the input means.

17. The method of claim 16, wherein the measurement device further comprises a first switching means; and wherein the method further comprises;

disabling by the switching means the power to the oil furnace when the vacuum level measured by the measurement device is equivalent to or exceeds the first specified vacuum level measurement set point.

18. The method of claim 17, wherein the measurement device further comprises a second input means and a second switching means, and wherein the method further comprises;

inputting by the second input means a second specified vacuum level measurement set point; and enabling by the second switching means a warning signal to an alarm device when the vacuum level measured by the measurement device is equivalent to or exceeds the second specified vacuum level measurement set point.

19. The method of claim 18, wherein the second specified vacuum level measurement set point is selected from a range of about 5 inches of water to about 9 inches of water, and wherein the first specified vacuum level measurement set point is selected from a range of about 9 inches of water to about 15 inches of water.

20. The method of claim 17, wherein the first specified vacuum level measurement set point is selected from a range of about 5 inches of water to about 15 inches of water.

21. The method of claim 16, wherein the means for disabling power to the oil furnace further comprises a switching device, wherein the measurement device further comprises a first switching means, and wherein the method further comprises;

enabling by the first switching means a control signal when a vacuum level measured by the measurement device is equivalent to or exceeds the first specified vacuum level measurement set point;

activating by the control signal, the switching device; and disabling by the switching device, the power to the oil furnace.

22. The method of claim 21, wherein the measurement device further comprises a second input means and a second switching means, and wherein the method further comprises;

accepting by the second input means, a second specified vacuum level measurement set point;

enabling by the second switching means a warning signal to an alarm device when a vacuum level measured by the measurement device is equivalent to or exceeds the second specified vacuum level measurement set point.

23. The method of claim 22, wherein the second specified vacuum level measurement set point is selected from a range of about 5 inches of water to about 9 inches of water, and wherein the first specified vacuum level measurement set point is selected from a range of about 9 inches of water to about 15 inches of water.

24. The method of claim 21, wherein the first specified vacuum level measurement set point is selected from a range of about 5 inches of water to about 15 inches of water.

25. The method of claim 15, wherein the means for disabling power to the oil furnace further comprises a control system comprising a controller, an input means, and a switching device, and wherein the method further comprises;

converting by the measurement device a vacuum level measured by the measurement device to a first electrical signal;

transmitting by the measurement device the first electrical signal to the controller;

accepting by the input means the first specified level measurement set point;

converting by the controller the first specified level measurement set point with a second electrical signal, comparing by the controller at least one level of the first electrical signal to a level of the second electrical;

transmitting by the controller a control signal to the switching device when the at least one level of the first electrical signal is equivalent to or exceeds the level of the second electrical signal;

activating by the control signal, the switching device; and disabling by the switching device, the power to the oil furnace.

26. The method of claim 25, further comprising accepting by the input means a second specified vacuum level measurement set point;

converting by the controller the second specified vacuum level measurement set point to a third electrical signal;

comparing by the controller a level of the third electrical signal to the at least one level of the first electrical signal; and transmitting by the controller a warning signal to an alarm device when the at least one level of the first electrical signal is equivalent to or exceeds the level of the third electrical signal.

27. The method of claim 26, wherein the second specified vacuum level measurement set point is selected from a range of about 5 inches of water to about 9 inches of water, and wherein the first specified vacuum level measurement set point is selected from a range of about 9 inches of water to about 15 inches of water.

28. The method of claim 25, wherein the first specified vacuum level measurement set point is selected from a range of about 5 inches of water to about 15 inches of water.

* * * * *